US005590793A

United States Patent [19]

Johansson

[11] Patent Number: 5,590,793

[45] Date of Patent: Jan. 7, 1997

[54] ROLL SCREEN WITH VARIABLE APERTURE

[75] Inventor: Jonny Johansson, Kiruna, Sweden

[73] Assignee: Luossavaara-Kiirunavaara AB, Kiruna, Sweden

[21] Appl. No.: 592,340

[22] PCT Filed: Jul. 5, 1994

[86] PCT No.: PCT/SE94/00667

§ 371 Date: Jan. 31, 1996

§ 102(e) Date: Jan. 31, 1996

[87] PCT Pub. No.: WO95/01846

PCT Pub. Date: Jan. 19, 1995

[30] Foreign Application Priority Data

Jul. 5, 1993 [SE] Sweden ..... 9302316

[51] Int. Cl.[6] ..... B07B 1/14

[52] U.S. Cl. ..... 209/668; 209/394; 209/673

[58] Field of Search ..... 209/667, 668, 209/394, 673

[56] References Cited

U.S. PATENT DOCUMENTS

| | | | |
|---|---|---|---|
| 1,173,737 | 2/1916 | Quesnell . | |
| 3,848,741 | 11/1974 | Haley et al. . | |
| 4,148,398 | 4/1979 | Mustikka . | |
| 4,209,097 | 6/1980 | Nordmark et al. . | |
| 4,311,242 | 1/1982 | Hnatko | 209/668 |
| 4,364,479 | 12/1982 | Sardo | 209/668 |
| 4,405,050 | 9/1983 | Fenton, Jr. et al. . | |
| 5,060,806 | 10/1991 | Savage | 209/668 |

FOREIGN PATENT DOCUMENTS

| | | | |
|---|---|---|---|
| 2132116 | 7/1984 | United Kingdom | 209/668 |
| 2222787 | 3/1990 | United Kingdom | 209/668 |

*Primary Examiner*—D. Glenn Dayoan

*Attorney, Agent, or Firm*—Watson Cole Stevens Davis, P.L.L.C.

[57] ABSTRACT

The invention relates to a roll screen having variable screening apertures having axle-fitted rolls which are spaced at adjustable distances apart and a device for adjusting this spacing. The roll spacing adjusting device functions to act on all rolls simultaneously, so that the spacing change will be the same for all rolls. The device includes two parallel running tracks (10, 11) and the distance between these tracks can be varied. A change in the distance between the running tracks causes the roll axle housings (6) to rotate and move the axles (2). This roll screen also includes a device for adjusting the individual distance between two consecutive rolls without affecting the distances between the remaining rolls. This device includes a spacer (32) which is inserted between the housings of the two rolls in which the roll axles are journalled. The roll screen is also provided with a separate elastic sealing element between the roll axle and the roll drive arrangement.

22 Claims, 4 Drawing Sheets

ROLL SCREEN WITH VARIABLE APERTURE

The present invention relates to a roll screen with variable screening apertures, comprising axle-fitted rolls which are disposed at variable distances apart, and means for adjusting said distances, said means acting upon all rolls-simultaneously so that the spacing between all rolls will be changed in relation to one another to the same extent.

It is normal with roll screens according to known techniques to drive the rolls so that they transport material and screen material at the same time. Screening is effected by under-dimensioned particles falling down through the screen apertures, these apertures being formed by the axially extending openings defined between the outer surfaces of mutually adjacent rolls. Roll screens are used within many different fields or areas. Examples in this regard include the manufacture of green pellets in the mining industry, sorting of pellets in other fields or areas, and screening different products in the agricultural and foodstuff industries. In this regard, there is a need to be able to vary the screen apertures to comply with the desired end product.

In addition to this need, roll screens that have variable screening apertures are encumbered with the serious problem that all play or clearance is/are accumulated, meaning that the requisite precision strived for when setting-up the screening apertures is lost. The prior publication SE-B-468, 832 proposes a roll screen with variable screening apertures which is intended to alleviate this problem. By mounting a cup spring and an anvil device between the blocks on which the roll axles are mounted, an by applying a force, for instance with the aid of a jack, which acts to compress the cup springs, it is possible to change the settings of all screen apertures as the block slides along a rail. However, it would be impossible in practice to adjust the screen apertures to a precise setting by means of the described invention, and to control the distance between adjacent rolls, because the friction acting in the slide blocks in which the roll units are journalled will vary. The problem of maintaining a precise setting in roll screens thus remains.

EP-A1-0418981 describes an arrangement for setting the distance or spacing between all rolls of the roll screen, this arrangement having the form of a mechanism which includes link arms of mutually different lengths connected to the rolls and to one another. This mechanism is relatively complicated and therewith expensive to produce, and rapidly results-in wear on the link arms and the subsequent occurrence of play and gaps.

Another problem is one of making individual adjustments to the screening aperture between two mutually adjacent rolls without affecting the distance between remaining rolls. This may be necessary, for instance, when the outer surface of a roll has been worn down such that the screening aperture becomes too large. The aforesaid Swedish publication also proposes an arrangement for manually adjusting an individual screening aperture with the aid of an adjusting device which acts against the aforesaid cup springs. However, the accuracy of remaining apertures can be changed for the same reason as that given above for the general setting, and consequently this arrangement is unsatisfactory.

The object of the present invention is to overcome the aforesaid problems by providing a roll screen in which all distances between the rolls can be varied in a simple way and can be set or adjusted simultaneously with precision and in the absence of play, as defined in the characterizing clause of claim 1.

Another object of the invention is to provide means which enable the distance between two rolls to be adjusted individually without affecting the distance between remaining rolls, as disclosed in the characterizing clause of claim 15.

Finally, another object of the invention is to provide an improved seal between the roll axles and the drive arrangement, as disclosed in the characterizing clause of claim 14.

Other characteristic features of the invention and advantages afforded thereby will be evident from the depending claims.

With the intention of illustrating the invention and the advantages afforded thereby, an exemplifying embodiment of the invention will now be described in detail with reference to the accompanying drawings, in which FIG. 1 is a cross-sectional view of an arrangement for varying the aperture width of an inventive roll screen;

The exemplifying embodiment of an inventive roll screen described below is particularly suited for use in the manufacture of pellets in the mining industry.

Figure 1:
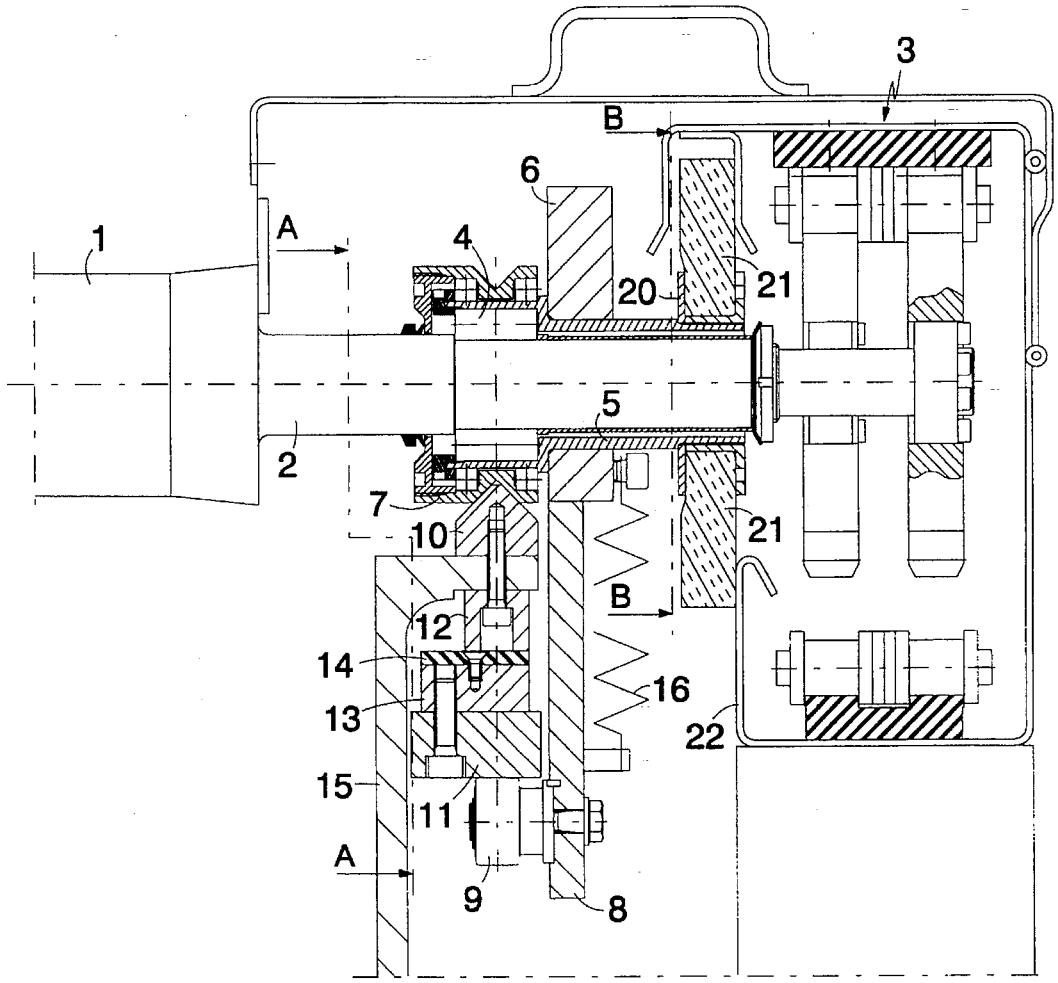

Shown in FIG. 1 is a roll 1 which belongs to a roll screen and which has an axle 2 driven by a drive arrangement 3. The drive arrangement 3 may have any suitable form whatsoever, but will normally include a chain wheel, or sprocket wheel, mounted on the roll axles and coacting with a drive chain. The axle_2 is journalled in a bearing 4 in a carrier sleeve 5 mounted in a housing 6. A carrier wheel 7 is journalled on the sleeve 5. The housing 6 is provided with an angled setting arm 8 on which there is mounted a runner 9.

Figure 2:
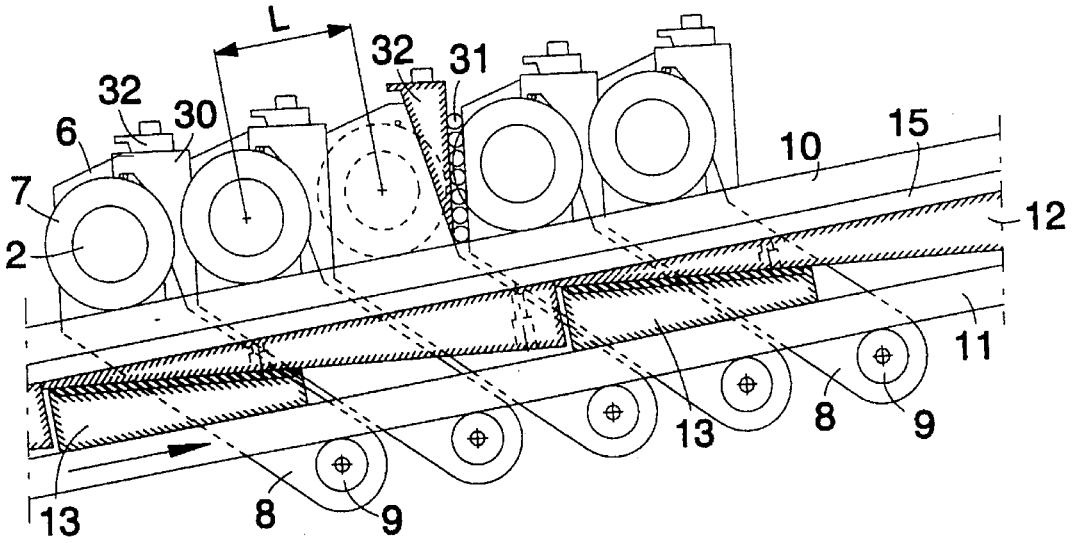
FIG. 2 is a side view of an inventive roll screen, partially in cross-section on the line A—A in FIG. 1.
Figure 3:
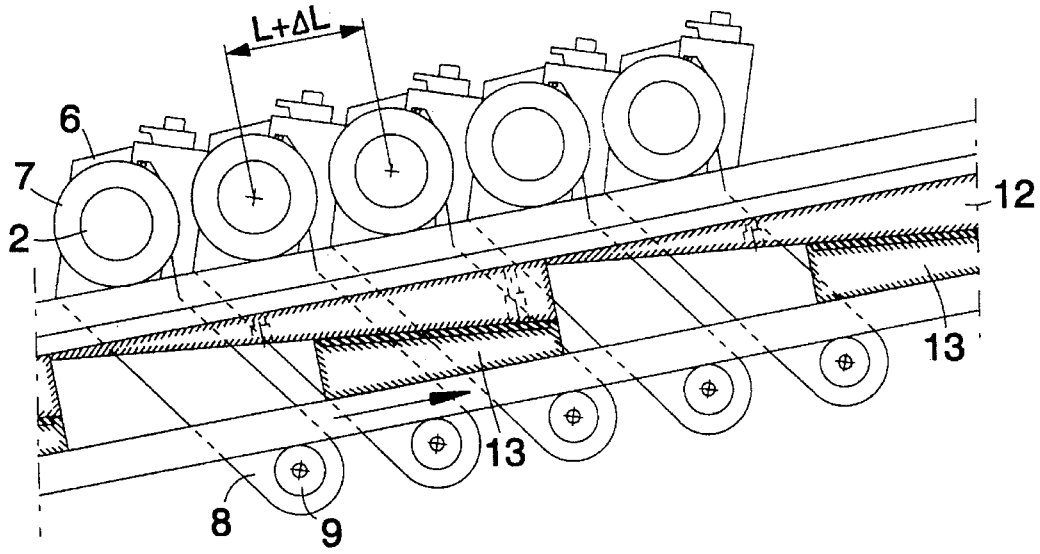
FIG. 3 is a side view of the roll screen shown in FIG. 2 but with the distance between the rolls changed.

FIG. 2 shows the roll screen from one side. The roll screen is inclined to the horizontal and material is introduced to the screen at its higher level and is then moved forwards and downwards by the rolls while screening the material, and the end product is separated at the lowest level of the screen. The roll positioned at the end of the screen, i.e. at the end of its lowest level, is fixed firmly. Alternatively, the last roll in the other end of the screen may be fixed instead. All other rolls are movable. It can be mentioned by way of-example that an 8 meter long screen may include seventy rolls and may have a width of between 2 and 3 meters.

The carrier wheel 7 moves along a track 10 while the runner 9 moves along a track 11. The tracks 10, 11 are parallel to one another and the distance therebetween can be adjusted. The track 10 along which the carrier wheel 7 moves is located above the running track 11 of the runner 9.

As will be seen from FIG. 2, the setting arm 8 is angled rearwardly in relation to the direction in which the material moves on the screen. This means that even though the carrier wheels 7 and the runners 9 are located in essentially the same vertical plane, their respective axles will be located in different planes as seen perpendicular to the surfaces of their respective running tracks 10, 11.

An arrangement for adjusting the distance between the running tracks is comprised of an arrangement having wedge-shaped parts which can be moved relative to one another. Thus, the underside of the upper running track 10 is provided with upper wedge-shaped projections 12, while the upper side of the bottom running track 11 is provided with lower wedge-shaped projections 13. In the illustrated embodiment, the upper wedge-shaped projections are fixed whereas the lower wedge-shaped projections can be moved with the aid of a movable rod which also forms the lower running track 11. The lower projections are therefore provided with a slide surface 14 on their upper surfaces. Alternatively, the upper wedge-shaped projections may be movable and the lower projections fixed, or both sets of projections may be movable. The upper running track 10 conveniently has a prismatic cross-section so as to stabilize movement of the carrier wheel 7 laterally. The top of the prismatic part may optionally be removed to provide a given clearance. The prismatic part 10 and the upper wedge-shaped projection 12 are secured to a fixed frame 15. The part 10 and the projection 12 are secured with screws in the illustrated embodiment, although other fastening means are conceivable. For instance, the wedge-shaped projection 12 may be welded directly to the frame 15.

As will be seen from FIG. 2, in a given position the distance between two roll axles is equal to L. This distance can be increased by moving the through-passing rod 11 to the right as indicated by the arrow in the Figure, i.e. rearwardly to the direction of material transportation, or upwards, therewith causing the wedges 13 to be moved rearwards/upwards and therewith increase the distance between the tracks 10, 11, while at the same time forcing the setting arms to move forwards/downwards as respective runners 9 move along the lower running track. This will result in the housings 6 being positioned obliquely, while the carrier wheels 7 move along the upper running track, therewith increasing the distance between mutually adjacent housings and thus also the distance between the roll axles 2, such that the distance between the latter will be L+ΔL.

The runners 9 are held in abutment with their running tracks with the aid of a spring force. This force is conveniently provided by a spring 16, shown only in FIG. 1, whose one end is attached to a lower part of a setting arm and whose other end is attached to the housing of a rearwardly lying roll, so as to ensure that the runners 9 are constantly pressed against their respective tracks 11. This is particularly important when the distance between the rolls is to be decreased by moving the rod downwards.

Naturally, it is not necessary to position the running tracks and their respective wedges one above the other, since variations with regard to their orientation are conceivable. For instance, the running tracks and their respective wedges may be positioned so that the distance adjustment is effected more or less horizontally instead of vertically as shown.

Other means for adjusting the distance between the two running tracks are also conceivable. The use of an eccentric device is an example of one such possibility.

In the described embodiment, there are used carrier wheels and runners which roll along the tracks. It is quite possible, however, to replace the carrier wheels and/or the runners with devices which are provided with a slide surface and which slide along respective tracks instead.

FIG. 2 also illustrates the arrangement for adjusting the individual distance between two rolls. This arrangement includes a bearing holder 30 which is preferably U-shaped and which partially embraces the top of the housing 6. The holder 30 is also supported against the housing by a pin. As will be seen from FIG. 4, the distance between two mutually adjacent rolls can be adjusted, and therewith also the screening aperture between these two rolls, by moving a spacer means 32, preferably a wedge-shaped spacer means, shown in the centre of the Figure with the bearing holder 30 removed, down through the bearing holder and along the sides of the housings 34, 35 of two consecutive rolls. The screening aperture between remaining rolls is not affected. The bearing holder holds a linear bearing 31 positioned where the spacer means glides against the upper/rear housing, so as to facilitate movement of the spacer.

Figure 4:
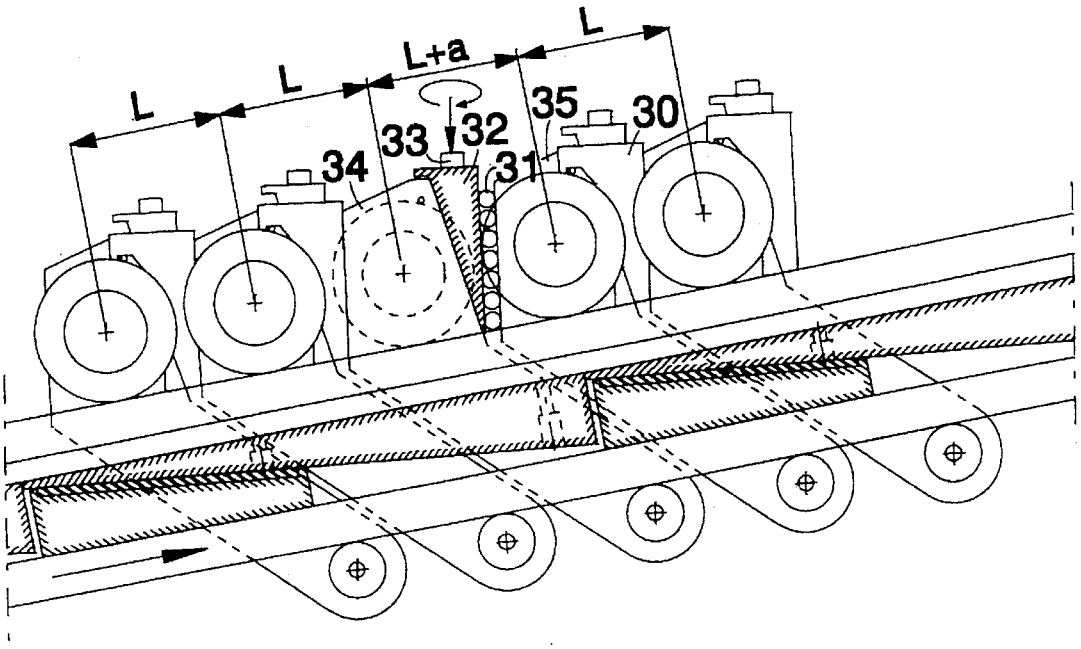
FIG. 4 is a side view of the inventive roll screen after adjusting the setting an individual screening aperture between two adjacent rolls.

FIG. 4 illustrates the spacer 32, shown in the centre of the Figure with the bearing holder removed, moved down and pressing two housings 34, 35 apart, so as to increase the distance of respective roll axles from the distance L in FIG. 2 to L+a. With regard to the remaining rolls, the only effect of the spacer 32 is to move the rolls while maintaining their mutual spacing L, since the setting arms are only moved in parallel and the distance between the carrier wheels and the runners is therewith not affected. The position of the spacer is suitably fixated with the aid of an adjuster screw 33, which is screwed into the housing or in some other suitable way.

It will be understood that the spacer may have any suitable form, for instance the form of an eccentric.

Figure 5:
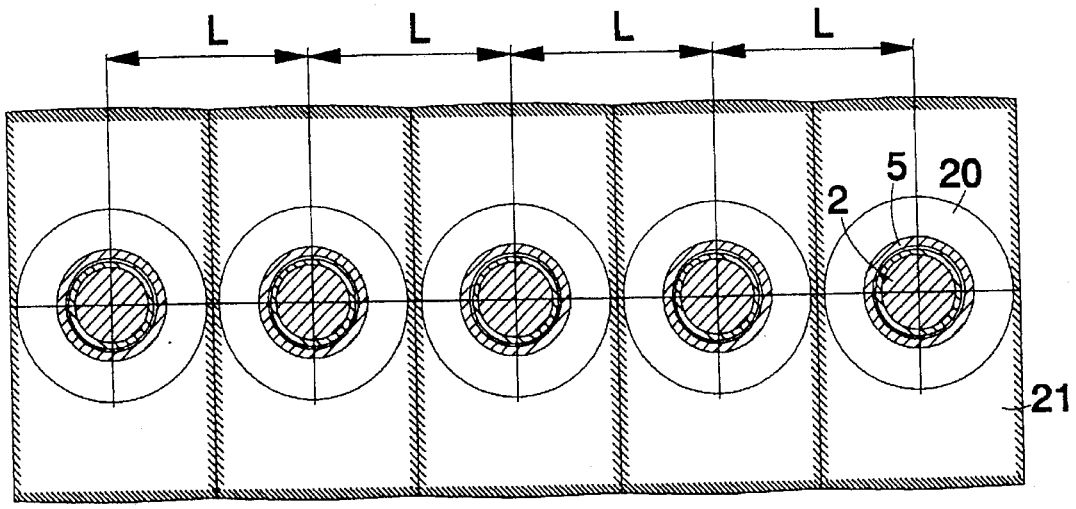
FIG. 5 is a cross-sectional view of an exemplifying embodiment of a sealing element, taken on the line B—B in FIG. 1.
Figure 6:
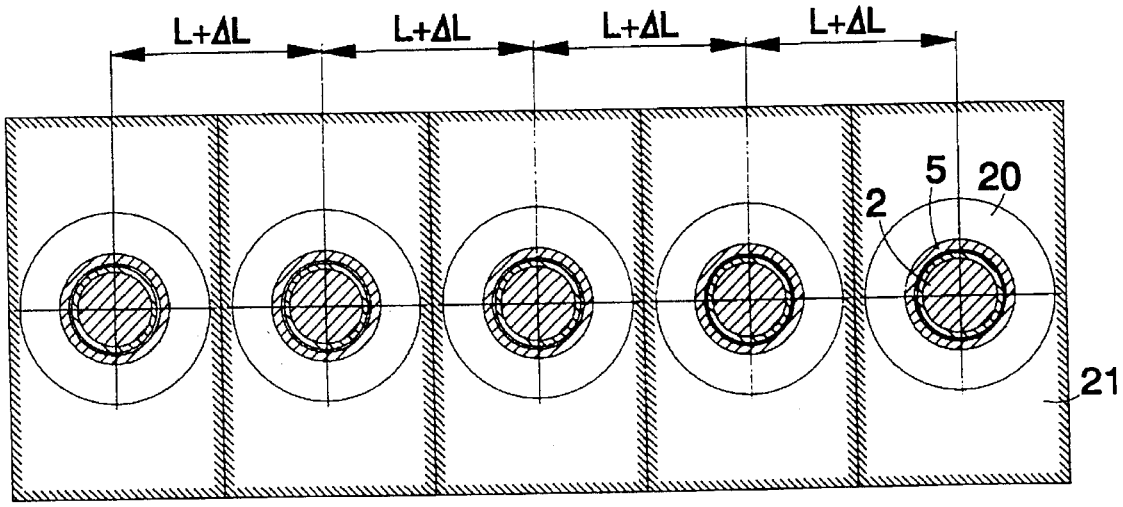
FIG. 6 illustrates the sealing element shown in FIG. 5 after having enlarged the screening aperture.

FIG. 1 shows that the carrier sleeve 5 is extended along the axle 2 up to the drive arrangement 3. Mounted on the sleeve via a holder 20 is a sealing element 21 which lies against the outer casing 22 of the drive arrangement. With the intention of solving the sealing problems that occur when the axle 2 is moved laterally when adjusting a screening aperture, the sealing element in the opening in the housing of the drive arrangement which normally extends along the entire roll screen is made of an elastic and pre-compressed material. Thus, as the axle is moved, the sealing element will either be compressed still further or will expand, without being permanently deformed. Preferably, each axle is provided with an individual seal and these seals will also seal against one another in all positions. FIG. 5 illustrates an exemplifying embodiment of a sealing element 21. The distance between the roll axles 2 is L in this case, as in the earlier cases. FIG. 6 shows how the seal adapts when the distance between the roll axles increases to L+ΔL. The sealing element may also be constructed to enable several axles to have one and the same sealing element, which will then be provided with several holes. Although the material will preferably be elastic, it will still, nevertheless, be relatively stiff and may consist of any one of different types of rubber or plastic materials. The seal is able to take-up an aperture change of at least 4 mm.

The described embodiment merely constitutes an example of the invention and does not limit the scope of the invention, since variations and modifications are conceivable within the scope of the inventive concept as defined in the following claims. For instance, the invention can be applied with roll screens in every field or area, irrespective of the material to be screened and the configuration of the screen rolls.

I claim:

1. A roll screen which has variable screening apertures and includes axle-fitted rolls (1) which are spaced at a variable distance from one another, and which further includes means for adjusting the roll spacing, said means acting-upon all rolls simultaneously so that the distance between the rolls will be adjusted to the same extent in relation to one another, characterized in that the means includes a first and a second running track (10, 11) which are parallel with one another and which have running surfaces which face away from one another and the distance between said tracks can be adjusted, a first device (7) for each roll (1) wherein the device is connected to said roll and can be moved along the first running surface as the distance between the tracks (10, 11) is changed, a second device (9) for each roll (1) which is able to move along said second running surface as the distance between the tracks (10, 11) is changed; and in that the two devices (7, 9) lie in two mutually separate planes as seen at right angles to the running surfaces.

2. A roll screen according to claim 1, wherein the first running track (10) is provided with at least one and preferably several first wedge-shaped projections (12) which face towards the second running track (11); in that the second running track (11) is provided with at least one and preferably several second wedge-shaped projections (13) which face towards the first wedge-shaped projections; and in that the first and the second wedge-shaped projections lie in abutment with each other and are able to move in relation to one another such as to adjust the distance between said running tracks and therewith also the distance between the roll devices (7, 9), causing the first device (7) of respective rolls to move along the first running track (10) and therewith also move the axles (2) supporting the rolls (1).

3. A roll screen according to claim 2, wherein the first running track (10) is mounted on a frame (15) and that the first wedge-shaped projections (12) are fixedly mounted on said frame; in that the second wedge-shaped projections (13) are mounted on a movable through-passing rod (11) which also forms the second running track; and in that the distance between the running tracks (10, 11) can be adjusted by moving the rod forwards or backwards such as to cause the second wedge-shaped projections (13) to slide on the first wedge-shaped projections (12).

4. A roll screen according to claim 1, wherein the distance between the running tracks (10, 11) is adjusted with the aid of an eccentric located between said running tracks.

5. A roll screen in accordance with claim 1, wherein the second device (9) is held in abutment with its running track (11) with the aid of a springing means (16).

6. A roll screen according to claim 1, wherein the axle (2) of each roll (1) is journalled in a sleeve (5) which carries said first device (7).

7. A roll screen according to claim 6, wherein said first device (7) is a carrier wheel capable of running along the first running surface, wherein the first running surface (10) preferably has a prismatic cross-section.

8. A roll screen according to claim 6, wherein the first device includes a slide surface which slides along the first running surface.

9. A roll screen according to claim 5, wherein the second device (9) is connected to one end of an angled setting arm (8); and in that the other end of the setting arm is attached to a roll-connected housing (6).

10. A roll screen according to claim 1, wherein the second device (9) is connected to one end of an angled setting arm (8); and in that the other end of the setting arm is attached to a roll-connected housing (6).

11. A roll screen according to claim 10, wherein the second device has the form of a runner (9) which is capable of rolling along the second running surface.

12. A roll screen according to claim 10, wherein the second device includes a slide surface which slides along said second running surface.

13. A roll screen according to claim 7, wherein the housing (6) is carried by the sleeve (7).

14. A roll screen according to claim 9, wherein the springing means is comprised of a spring (16) mounted between the setting arm (8) of one roll and the housing (6) of another roll that is included in the rolls which are located in the direction in which the setting arm is angled.

15. A roll screen according to claim 6, wherein the sleeve (5) extends along the axle (2) up to a drive arrangement (3) which extends along the roll screen and drives the rolls thereof; and in that the drive arrangement is sealed against the sleeve by means of a sealing element (21) which is comprised of an elastic and pre-compressed material capable of taking-up changes in the distances between the rolls while retaining its sealing effect.

16. A roll screen according to claim 1, wherein the screen also includes means (32) for adjusting the individual distance between two consecutive rolls while retaining the spacings of remaining rolls.

17. A roll screen according to claim 16, wherein the axle(2) of each roll (1) is journalled in a housing (6); and in that said means (32) includes a spacer which is intended to be inserted adjustly between two consecutive roll housings (34, 35) so as to influence the distance between said housing.

18. A roll screen according to claim 17, wherein the roll screen includes a bearing holder (30), preferably a U-shaped holder, which supports against a roll housing (34) via a pin and carries a linear bearing (31) towards a nearest adjacent housing (35); and in that said spacer (32) can be moved within the bearing holder to a position in which it lies between the respective housings (34, 35) of two rolls therewith enabling the distance between these rolls to be varied.

19. A roll screen according to claim 18, wherein the spacer (32) is generally wedge-shaped and can be moved up or down in the bearing holder.

20. A roll screen according to claim 18, wherein the height position of the spacer (32) is adjusted with the aid of an adjusting means (33), preferably in the form of a screw which is screwed into one of the roll housings.

21. A roll screen according to claim 20, wherein the spacer (32) is an eccentric which can be rotated between the housings.

22. A roll screen according to claim 6, wherein the second device (9) is connected to one end of an angled setting arm (8); and in that the other end of the setting arm is attached to a roll-connected housing (6).

* * * * *